United States Patent [19]

Drago et al.

[11] Patent Number: 4,904,179

[45] Date of Patent: Feb. 27, 1990

[54] LOW $NO_x$ PRIMARY ZONE RADIANT SCREEN DEVICE

[75] Inventors: Thomas E. Drago, Liverpool; Chester D. Ripka, Syracuse, both of N.Y.

[73] Assignee: Carrier Corporation, Syracuse, N.Y.

[21] Appl. No.: 935,070

[22] Filed: Nov. 21, 1986

Related U.S. Application Data

[63] Continuation of Ser. No. 767,580, Aug. 20, 1985, abandoned.

[51] Int. Cl.[4] ..... F23D 14/12

[52] U.S. Cl. ..... 431/2; 431/347; 126/110 R

[58] Field of Search ..... 431/347, 350, 2, 8, 431/354; 126/110 R, 116 R

[56] References Cited

U.S. PATENT DOCUMENTS

| | | | |
|---|---|---|---|
| 951,060 | 3/1910 | Driessche | 431/347 |
| 2,808,047 | 10/1957 | Jaye et al. | 126/116 R |
| 2,980,104 | 4/1961 | Patrick et al. | 431/347 |
| 3,169,572 | 2/1965 | Constance et al. | 158/116 |
| 3,251,393 | 5/1966 | Beach et al. | 431/347 |
| 3,312,269 | 4/1967 | Johnson | 431/347 |
| 3,574,507 | 4/1971 | Kydd | 431/350 |
| 3,649,211 | 3/1972 | Vosper | 431/347 |
| 3,706,303 | 12/1972 | Hapgood | 126/116 R |
| 3,726,633 | 4/1973 | Vasilakis et al. | 431/329 |
| 3,973,395 | 8/1976 | Markowski et al. | 60/39.65 |
| 4,018,553 | 4/1977 | Baker et al. | 431/7 |
| 4,045,956 | 9/1977 | Markowski et al. | 60/39.65 |
| 4,275,704 | 6/1981 | Vulssoz | 126/92 R |
| 4,285,666 | 8/1981 | Burton et al. | 431/347 |
| 4,484,886 | 11/1984 | Nakamura et al. | 431/201 |
| 4,525,141 | 6/1985 | De Werth et al. | 431/347 |
| 4,616,994 | 10/1986 | Tomlinson | 431/347 |

FOREIGN PATENT DOCUMENTS 1522879 3/1968 France .

*Primary Examiner*—Carroll B. Dority
*Attorney, Agent, or Firm*—Robert H. Kelly

[57] ABSTRACT

An apparatus and method for use in a combustion system of a gas-fired furnace to inhibit formation of oxides of nitrogen ($NO_x$) by the combustion system thereby reducing $NO_x$ emissions from the combustion system. The apparatus is made of a material which is positioned at the interface of the primary zone and the secondary zone of a combustion flame produced by a two-zone burner which is part of the combustion system, to temper the combustion flame by absorbing thermal energy from the combustion flame. The device sufficiently tempers the combustion flame to limit peak combustion flame temperatures and residence times at these peak combustion flame temperatures to levels which inhibit formation of oxides of nitrogen.

5 Claims, 2 Drawing Sheets

LOW $NO_x$ PRIMARY ZONE RADIANT SCREEN DEVICE

This application is a continuation of application Ser. No. 767,580 filed Aug. 20, 1985 now abandoned.

BACKGROUND OF THE INVENTION

The present invention relates to combustion systems, and more particularly, to a device and method for inhibiting formation of oxides of nitrogen ($NO_x$) in a two-zone diffusion flame of a combustion system of a gas-fired furnace.

As a result of the combustion process, combustion systems normally generate gaseous combustion products which include oxides of nitrogen ($NO_x$) which are vented to the atmosphere as flue gases. It is desirable to limit these $NO_x$ emissions since $NO_x$ is considered a pollutant and combustion systems for gas-fired furnaces sold in certain geographical areas must meet strict $NO_x$ emission standards.

It has been observed that the two most important parameters in the formation of $NO_x$ are peak combustion temperature and residence time at peak temperatures. One technique for limiting $NO_x$ emissions by controlling peak combustion flame temperatures is to provide a supplemental air flow for cooling the combustion flame in a combustion system. Another technique is to alter the combustion system to minimize the formation of $NO_x$. However, these techniques, while limiting $NO_x$ formation, may adversely affect the combustion process of the combustion system by causing incomplete combustion and/or by adversely affecting the combustion process in other ways. Also, these techniques may require a major redesign of certain components of the combustion system, such as a redesign of burners and combustion chambers or heat exchangers of the combustion system, thereby rendering these techniques undesirable for retrofitting existing combustion systems. Another technique used with two-zone monoport inshot burners, which generally emit a lower level of $NO_x$ emissions than multi-port burners, is to position a piece of material at the periphery of the secondary flame of the two-zone diffusion flame to temper the combustion flame by absorbing thermal energy from the combustion flame. In this technique, the device absorbs thermal energy from the combustion flame at a rate which inhibits formation of $NO_x$ while allowing substantial complete combustion of the fuel supplied to the burner. These devices are generally cylindrical screens juxtaposed to the periphery of the cooler, secondary combustion zone. Also, these devices aerodynamically smooth at least a portion of the periphery of the combustion flame, thereby inhibiting formation of eddies by near-stoichiometric mixtures of combustion substances at the periphery of the two-zone diffusion flame which are capable of forming relatively large amounts of $NO_x$.

SUMMARY OF THE INVENTION

The present invention is directed to a method and apparatus for reducing $NO_x$ emission levels from gas-fired burners having a two-zone diffusion flame.

It is an object of the present invention to limit $NO_x$ emissions from a combustion system to a desired level without significantly reducing the combustion efficiency of the combustion system or otherwise adversely affecting the combustion process of the combustion system.

A further object of the present invention is to provide an easily installed and simple means for altering combustion systems to limit their $NO_x$ emissions to a desired level without significantly reducing the combustion efficiency or otherwise adversely affecting the combustion process of the combustion system.

A still further object of the present invention is to reduce the $NO_x$ production below a level of 40 nanograms/joule at a specific minimum California seasonal efficiency level of 71%.

Another object of the present invention is to limit the $NO_x$ emissions from any burner, i.e. an inshot burner, a slotted burner, or a ribbon burner having a two-zone diffusion flame.

These and other objects of the present invention are attained by providing a gas-fired combustion system having a two-zone diffusion flame with a device positioned at the burning interface of the primary air blue cone and secondary diffusion layer of each flame to inhibit the formation of $NO_x$ by the combustion system. The device comprises a piece of material positioned relative to the primary zone or hottest portion of the combustion flame produced by the burner to temper the combustion flame by absorbing thermal energy from the hottest portion, i.e. the blue primary cone, of the combustion flame. The device is sized, positioned, and configured relative to the primary zone of the two-zone diffusion flame to absorb thermal energy from the combustion flame at a rate which limits peak flame temperatures and residence times at these peak flame temperatures to levels which inhibit formation of $NO_x$ while allowing substantially complete combustion of the fuel supplied to the burner. Preferably, the device is made of a material, such as stainless steel, which is resistant to oxidation at the relatively high primary zone combustion flame temperatures, and which radiates thermal energy which it absorbs from the combustion flame, to its surroundings.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of the specification, and in which reference numerals shown in the drawings designate like or corresponding parts throughout the same.

FIG. 3 is a side elevation view of the ribbon type burner of FIG. 2: an

DESCRIPTION OF THE PREFERRED EMBODIMENT

Figure 1:
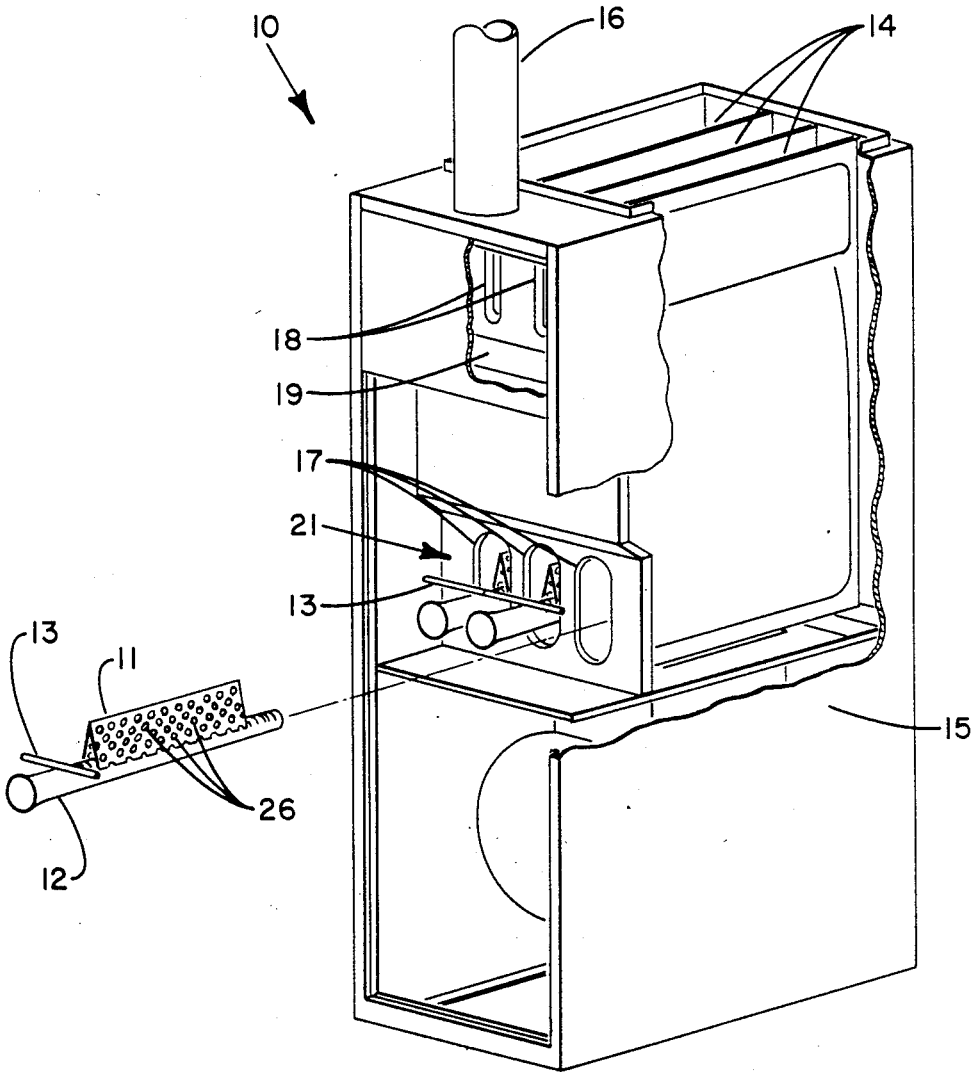
FIG. 1 is a partially exploded and partly broken away isometric view of a gas-fired furnace having a ribbon type burner.

Referring to FIG. 1, a partly exploded and partly broken away view is shown of a gas-fired furnace 10 having a natural draft or multi-port slotted type burner 12 and a primary zone radiator structure 11 which is a preferred embodiment of a device for inhibiting $NO_x$ formation by this type of combustion system in accordance with the principles of the present invention. As shown in FIG. 1, the flame radiator structure 11 is an inverted V-shaped perforated structure having a generally triangular cross-section which will be described in more detail hereinafter. In addition to the flame radiator structure 11 and the burner 12, the gas-fired furnace 10 includes heat exchangers 14, a furnace cabinet 15, and a flue pipe 16. Each of the heat exchangers 14 is a natural draft heat exchanger cell having an inlet opening 17 through which the ribbon type burner 12 projects. Also, each of the heat exchangers 14 has an outlet opening 18 through which flue gases are discharged from the heat exchanger into a flue gas collection chamber 19 from which the flue gases pass into the flue pipe 16 to be discharged from the furnace 10.

For ease of illustration, only three heat exchangers 14 are shown in FIG. 1. However, it is to be understood that the furnace 10 may have any number of heat exchangers 14 each with its own burner 12 and flame radiator structure 11.

When assembled in the gas-fired furnace 10, the multi-port burner 12 with its attached inverted V-shaped radiator structure 11 is generally located through the heat exchanger inlet opening 17 and is held in this position by any suitable means. Preferably, as shown in FIG. 1, the ribbon type burner 12 has a burner crossover tube 13 which is secured to each burner which in turn is secured, for example by by a bracket screwed to the area 21 surrounding the inlet opening 17. Alternatively, the crossover tube can be formed as part of the burner.

Figure 4:
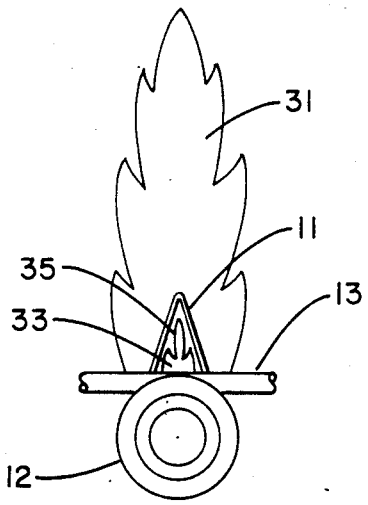
FIG. 4 is an elevation view of a two-zone diffusion flame emanating from the ribbon type burner of FIGS. 2 and 3 incorporating the primary zone radiant screen device of the present invention.

The multi-port burner 12 includes a regulator and spud (not shown) for supplying fuel to the burner 12. Fuel is supplied through the regulator and ignited on the burner by way of the crossover tube 13 by an ignition system (not shown). The burner, when positioned inside the heat exchanger, produces a two-zone diffusion flame resulting in off-stoichiometric combustion in the primary zone. The combustion flame is actually divided into two distinct parts, a blue primary cone 33 and a secondary diffusion layer 31 as shown in FIG. 4. The air/fuel mixture entering the burner is fuel rich, that is, the primary air is some value less than stoichiometric. Primary combustion takes place near the burner producing a triangular shaped, blue primary cone 33, and then at some subsequent point further away from the burner secondary air is added in order to produce a secondary diffusion layer 31. The normal average operating temperatures of the blue primary cone are about 3000° F. (1648° C.) while the average secondary zone or diffusion layer operates about 1800° F. (1105° C.).

According to the present invention, undesirable formation of $NO_x$ by the furnace 10 is inhibited by the presence of the inverted V-shaped flame radiator structure 11 which tempers the primary combustion flame produced by the burner 12 by absorbing thermal energy from the primary combustion flame. The flame radiator structure 11 limits peak flame temperatures and residence times at these peak flame temperatures, at the primary zone of the two-zone diffusion flame, to levels which inhibit formation of $NO_x$ while allowing substantially complete combustion of the fuel supplied to the burner 12.

Of course, different regions of the diffusion flame have different peak flame temperatures and different residence times at these peak flame temperatures depending on their location in the combustion flame. Normally, the temperature of a given region of the combustion flame will vary within a certain temperature range as a function of time and will remain at the peak flame temperature within this temperature range for a certain amount of time (residence time) during the time period of operation of the burner 12. Throughout this patent application the terms "peak flame temperature" and "residence time at a peak flame temperature" are used in reference to a given region of the combustion flame and the plurals of these terms are used to collectively refer to several of these regions.

Figure 2:
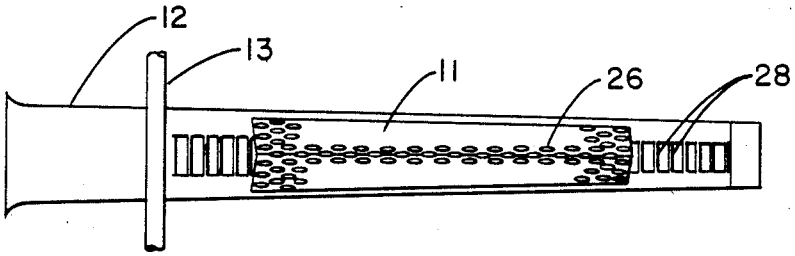
FIG. 2 is a plan view of the ribbon type burner illustrated in FIG. 1 incorporating the primary zone radiant screen device made in accordance with the present invention.
Figure 3:
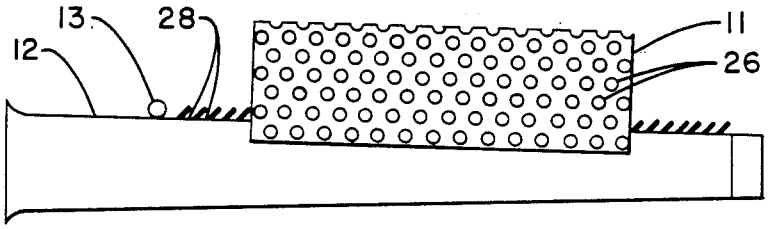

It has been found that a desirable shape for the flame radiator structure 11 of a ribbon type burner, as shown in FIGS. 2 and 3, is an inverted V-shaped structure located at the periphery of the primary zone where the radiator structure 11 is able to efficiently and effectively reduce peak flame temperatures and residence times at these peak flame temperatures to desired levels. With an inshot burner, a desirable shape for the radiator structure would be a cone structure located at the interface between the primary air cone and the secondary diffusion layer. The periphery of the primary cone of the combustion flame is the most desirable location for the flame radiator structure 11 because, as discussed above, the blue primary flame is the hottest portion of the two-zone combustion flame. In fact, it has been observed that if the flame radiator structure 11 is moved to the periphery of the secondary flame, the structure 11 is substantially less effective in inhibiting $NO_x$ formation compared to when the structure 11 is located at the periphery of the primary cone.

Also, as best shown in FIG. 4 the flame radiator structure 11 is a triangular shaped perforated sheet metal positioned at the periphery 35 of the primary zone 33 of the two-zone combustion flame produced by the burner 12 so that the flame radiator structure 11 is adjacent to and in contact with the outer surface or periphery of the primary zone of the combustion flame, i.e. the interface of the primary flame blue cone. Of course, normally, the periphery of the primary combustion flame will randomly fluctuate in location throughout any time period of operation of the burner 12. Therefore, for a primary combustion flame projected from any particular burner 12, it is desirable to determine the average location of the periphery of the primary zone of the combustion flame by observing the combustion flame during operation of the burner 12, and to position the triangular shaped flame radiator structure 11 relative to this average location of the periphery of the primary combustion flame. Thus, in this patent application, when it is stated that the flame radiator structure 11 is position "at" the periphery of the primary combustion flame, this means that the flame radiator structure 11 is positioned relative to the average location of the periphery of the primary combustion flame so that when the burner 12 is operating the periphery 35 of the primary combustion flame 33 randomly fluctuates about the position of the triangular shaped flame radiator structure 11.

Also, it should be noted that the flame radiator structure 11 is made of a material having physical properties, such as coefficient of thermal conductivity and radiation characteristics (that is characteristics such as the rate at which the material will radiate heat energy to its surroundings at certain elevated temperatures), so that the structure 11 tempers the combustion flame produced by the burner 12 by absorbing thermal energy from the primary zone of the combustion flame at a selected rate. Also, as will be readily apparent to one of ordinary skill in the art to which the present invention pertains, the physical properties of the material from which the structure 11 is made are very important relative to the ability of a structure to absorb and radiate thermal energy. Some materials are able to absorb and radiate thermal energy faster and more efficiently than other materials. In certain applications, such as gas-fired furnace applications, it is desirable to utilize the available thermal energy in the most efficient manner possible. Therefore, it is preferable in such a furnace application to use a structure 11 having a material which will allow the structure 11 to radiate absorbed thermal energy to its surroundings, namely to the walls of a heat exchanger surrounding the ribbon type burner 12 and structure 11, so that the available thermal energy may be efficiently utilized by the furnace. Further, the material from which the flame radiator structure is made must be capable of being cycled many times from normal room temperatures to relatively high combustion flame temperatures without being severely damaged by oxidizing, corroding, breaking, bending, cracking, or being damaged in other ways due to this thermal cycling. In these applications, it has been found that metallic materials, such as stainless steel, and other steel alloys which are resistant to oxidation at relatively high combustion flame temperatures are particularly suitable materials from which to make the flame radiator structure 11. Type 310, 314 and 330 stainless steels appear especially desirable as a material from a reliability viewpoint.

As shown in FIGS. 1–3, the flame radiator structure 11 of the present invention comprises a perforated sheet having a generally inverted V-shaped cross-section. This sheet generally extends along the edges of the burner and covers the ports 28 of the burner and extends from one end of the burner to the other. Thus, this perforated inverted V-shaped flame radiator structure 11 has the desired feature of not interfering with the flow of products of combustion away from the combustion flame produced by the burner 12. The perforations 26 in the radiator structure are sized so that the products of combustion may flow freely through the structure 11 away from the combustion flame while sufficient material is present in the structure 11 to achieve the desired tempering of the combustion flame.

Of course, the foregoing description is directed to a preferred embodiment of the present invention and various modifications and other embodiments of the present invention will be readily apparent to one of ordinary skill in the art to which the present invention pertains. Therefore, while the present invention has been described in conjunction with a particular embodiment it is to be understood that various modifications and other embodiments of the present invention may be made without departing from the scope of the invention as described and as claimed in the appended claims.

What is claimed is:

1. A combustion system for a gas-fired furnace comprising:

a combustion type burner to provide a two-zone diffusion flame during combustion of a mixture of fuel and air, the flame having a primary zone and a cooler secondary zone surrounding the primary zone said primary zone having an outer surface forming an interface with said secondary zone;

a heat exchanger defining a flow path for combustion products said heat exchanger having an inlet and an outlet said burner disposed within said heat exchanger near said inlet; and a means for inhibiting formation of oxides of nitrogen by controlling peak combustion flame temperatures and residence times at the peak flame temperatures said means including a piece of metal material having a plurality of apertures therethrough, said piece of material mounted to said burner for generally contacting the entire said outer surface of the primary zone of the flame and positioned at the interface of the primary zone and the secondary zone whereby the primary zone and secondary zone are entirely separated by said piece of material to allow said piece of material to absorb thermal energy from hotter primary zone at a rate which limits peak flame temperatures whereby the formation of oxides of nitrogen are inhibited, said piece of material having a generally inverted V-shaped transverse cross-section with the open end of the V-shaped material extending along and adjacent edges of the burner wherein substantially all of the products of combustion flow through said apertures in said piece of material.

2. A combustion system for a gas-fired furnace as recited in claim 1 wherein said material comprises a metal which is resistant to oxidation at normal operating temperatures of said primary zone.

3. A combustion system for a gas-fired furnace as recited in claim 2 wherein said metal comprises stainless steel.

4. A method of inhibiting the formation of $NO_X$ in a combustion system of a gas-fired furnace, the combustion system having at least one two-zone combustion type burner which produces a flame having a primary zone and a cooler secondary zone surrounding the primary zone, said method comprising the steps of:

discharging a mixture of fuel and air from the burner;

causing combustion of said mixture of fuel and air to produce the two-zone flame in a heat exchanger of the gas-fired furnace; and drawing substantially all of the products of combustion of the two-zone flame through a piece of metal material having a plurality of apertures therethrough whereby the outer surface of the primary zone is generally in contact with the entire interface of the metal material, said piece of material having a generally inverted V-shaped transverse cross-section with the open end of the V-shaped material adjacent the edges of the burner whereby said piece of material absorbs thermal energy from the flame at a rate which limits peak flame temperatures and residence times at these peak flame temperatures to levels which inhibit formation of oxides of nitrogen.

5. A combustion system for a gas-fired furnace as recited in claim 3 wherein said two-zone flame combustion type burner is a multi-port ribbon burner.

* * * * *